United States Patent [19]

Kurita

[11] 3,985,438

[45] Oct. 12, 1976

[54] EXPOSURE CONTROL DEVICE

[75] Inventor: Takaji Kurita, Kawachinagano, Japan

[73] Assignee: Minolta Camera Kabushiki Kaisha, Osaka, Japan

[22] Filed: Jan. 27, 1975

[21] Appl. No.: 544,343

[30] Foreign Application Priority Data

Feb. 19, 1974 Japan ..... 49-20103

[52] U.S. Cl. ..... 355/11; 355/14; 355/16; 355/66; 355/67

[51] Int. Cl.[2] ..... G03G 15/00

[58] Field of Search ..... 355/14, 3 BE, 3 R, 11, 355/8, 16, 66, 67

[56] References Cited

UNITED STATES PATENTS

| | | | |
|---|---|---|---|
| 3,062,108 | 11/1962 | Mayo | 355/11 X |
| 3,432,231 | 3/1969 | Gardner | 355/8 |
| 3,547,533 | 12/1970 | Stokes et al. | 355/3 R |
| 3,709,603 | 1/1973 | Furuichi | 355/3 R |
| 3,834,807 | 9/1974 | Fuller et al. | 355/8 X |

*Primary Examiner*—R. L. Moses

*Attorney, Agent, or Firm*—Wenderoth, Lind & Ponack

[57] ABSTRACT

An exposure control device to be incorporated in an electrophotographic copying apparatus of the full frame exposure type with a moving photoreceptor, in which device a lens for projecting a light image of an original placed on a stationary platform onto the moving photoreceptor is adapted, during the flashing period of flash lamps for illuminating the original, to move in the same direction as the photoreceptor at a rate $1/m+1$ times the moving rate of the photoreceptor for full frame exposure, by which arrangement, not only sufficient duration of flashing time of the flash lamps is available in high speed copying with consequent long life of the flash lamps, but definite, clear copies with high image resolution can be obtained.

16 Claims, 7 Drawing Figures

Figure 1:
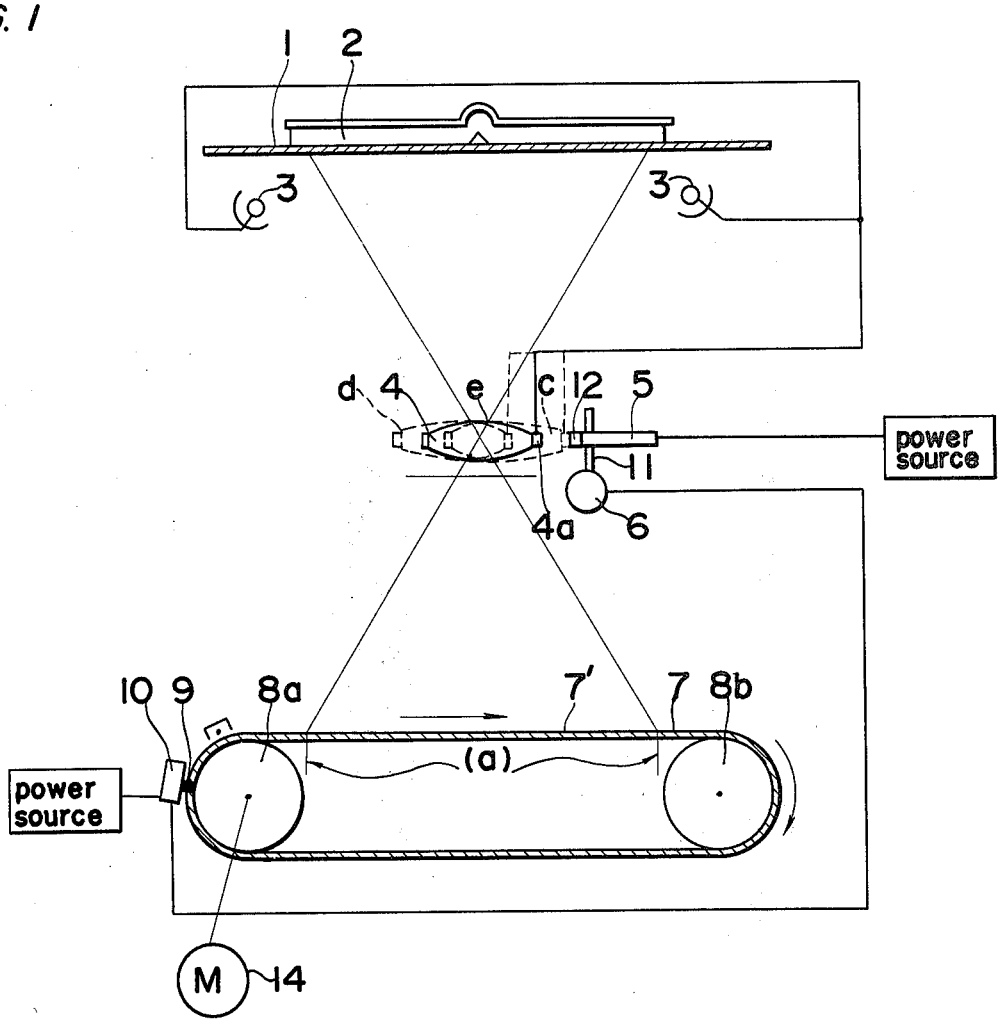

L
L'
P
4
4a
11
12
13
15
16
5
r

EXPOSURE CONTROL DEVICE

The present invention relates to exposure control in image reproduction, and more particularly to a method and device for exposure control to be incorporated in an electrophotographic copying apparatus of the full frame exposure type.

Commonly, in electrophotographic copying apparatus of the full frame exposure type, a light image of an original placed on a stationary transparent platform and momentarily illuminated by flash lamps is projected, through an optical system including a projection lens, onto a known photoreceptor surface, for example, a xerographic plate, a photographic film or the like with the photoreceptor kept stationary. In order to achieve a high speed copying operation, however, it is absolutely necessary to effect full frame exposure from a stationary original onto a photoreceptor continuously moving at a constant rate, and such full frame exposure on the moving photoreceptor surface has been very difficult as compared with that on a stationary photoreceptor, tending to blur the image, especially when a photoreceptor with relatively low sensitivity, such as a xerographic plate is employed, the degree of such blur of the image being commonly referred to as image resolution or resolving power which is dependent on the relation between the duration of the flashing time of the flash lamps and the moving rate of the photoreceptor. By shortening the duration of the flashing time and increasing the moving rate of the photoreceptor, the image resolution may be improved to achieve clear and definite exposure at high speed copying, but practically it is impossible to extremely reduce the duration of the flashing time of the lamps to any extreme degree, because the life of xenon lamps with high exposure efficiency commonly used for the flash lamps for the above described purpose is excessively shortened if the duration of the flashing time is reduced to $3\times 10^{-4}$ second and under. The tendency is especially great in xenon lamps having a large capacity, so that the duration of the flashing time for such lamps should preferably be $10^{-3}$ second at the minimum. On the other hand, for maintaining the earlier mentioned resolving power at the minimum limit of aproximately 1:10 mm under for a duration of the flashing time of $10^{-3}$ second, it is inevitably necessary to maintain the moving rate of the photoreceptor at a low level below 10 cm/sec., at which moving rate of the photoreceptor, however, a high speed copying operation can not be effected.

In most of the conventional copying apparatuses for exposing from a stationary original onto a moving photoreceptor, complicated scanning mechanisms which incremently scan the original at a rate synchronized with the rate of the movement of the photoreceptor have been employed instead of the full frame exposure, which arrangements, however, are inevitably inefficient from the view point of high speed copying.

In order to overcome such disadvantages, there has conventionally been proposed an exposure control device to be incorporated in a copying apparatus for forming a full frame image of a stationary original onto the photosensitive surface of a moving photorceptor, for example, by U.S. Pat. No. 3,432,231, which device, however, still employs considerably complicated mechanisms which include a mirror oscillable in timed synchronous movement with the movement of the photoreceptor surface with a high intensity light source intermittently illuminating the stationary original to flash a light image of the original onto the photoreceptor surface, and in which device it is essential that relative movement between the moving photoreceptor belt and the light rays reflected from the oscillable mirror be kept at a minimum or substantially eliminated.

Accordingly, an essential object of the present invention is to provide an exposure control device to be incorporated in an electrophotographic copying apparatus of the full frame exposure type which is simple in construction and low in manufacturing cost with substantial elimination of the disadvantages inherent in conventional exposure control devices.

Another important object of the present invention is to provide an improved multiple full frame exposure method of a stationary original onto a moving photoreceptor surface for efficient high speed copying.

A further object of the present invention is to provide an exposure control device of the above described type by which clear, definite images with high image resolution can be produced in high speed copying operation.

A still further object of the present invention is to provide an exposure control device of the above described type which functions accurately and which provides for long life of flash lamps for illumination.

In concept, the present invention advantageously utilizes the known principle that, in projecting the light image of an original to be copied onto a photoreceptor surface moving at a constant rate through a lens with a magnification m, it is possible to project such light image onto the photoreceptor surface without any relative movement between the light image and the image forming surface of the photoreceptor, in the same state as in the stationary arrangements, if the lens is moved at a speed $1/m+1$ times that of the moving photoreceptor.

According to a preferred embodiment of the present invention, a lens for projecting the light image of the original onto the moving photoreceptor surface is adapted, during the flashing period of the flash lamps for illuminating the original, to move in the same direction as the photoreceptor at a rate $1/m+1$ times the moving rate of the photorceptor for full frame exposure, by which arrangement, not only is a sufficient duration of flashing time available even in high speed reproduction with consequent long life of the flashing lamps, but clear, definite copies with high image resolution can advantageously be obtained.

Furthermore, the projection lens driving mechanism including a cam associated with the frame of the projection lens each having an electrical contact point to flash the flashing lamps in proper timing with the movement of the projection lens is simple in construction, and yet functions accurately in functioning, resulting in low manufacturing cost.

Figure 3:
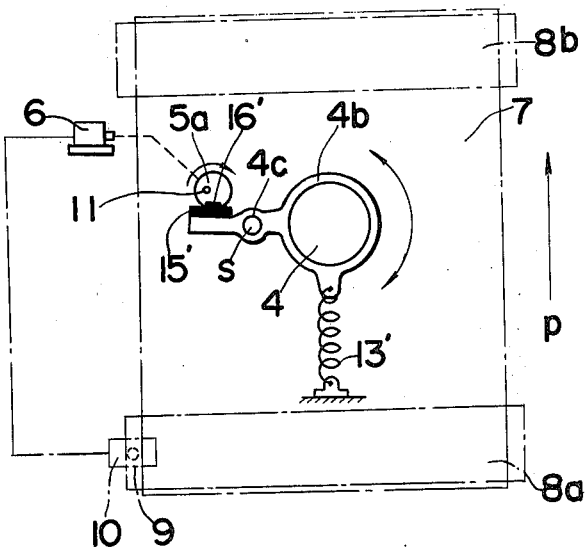
Figure 4:
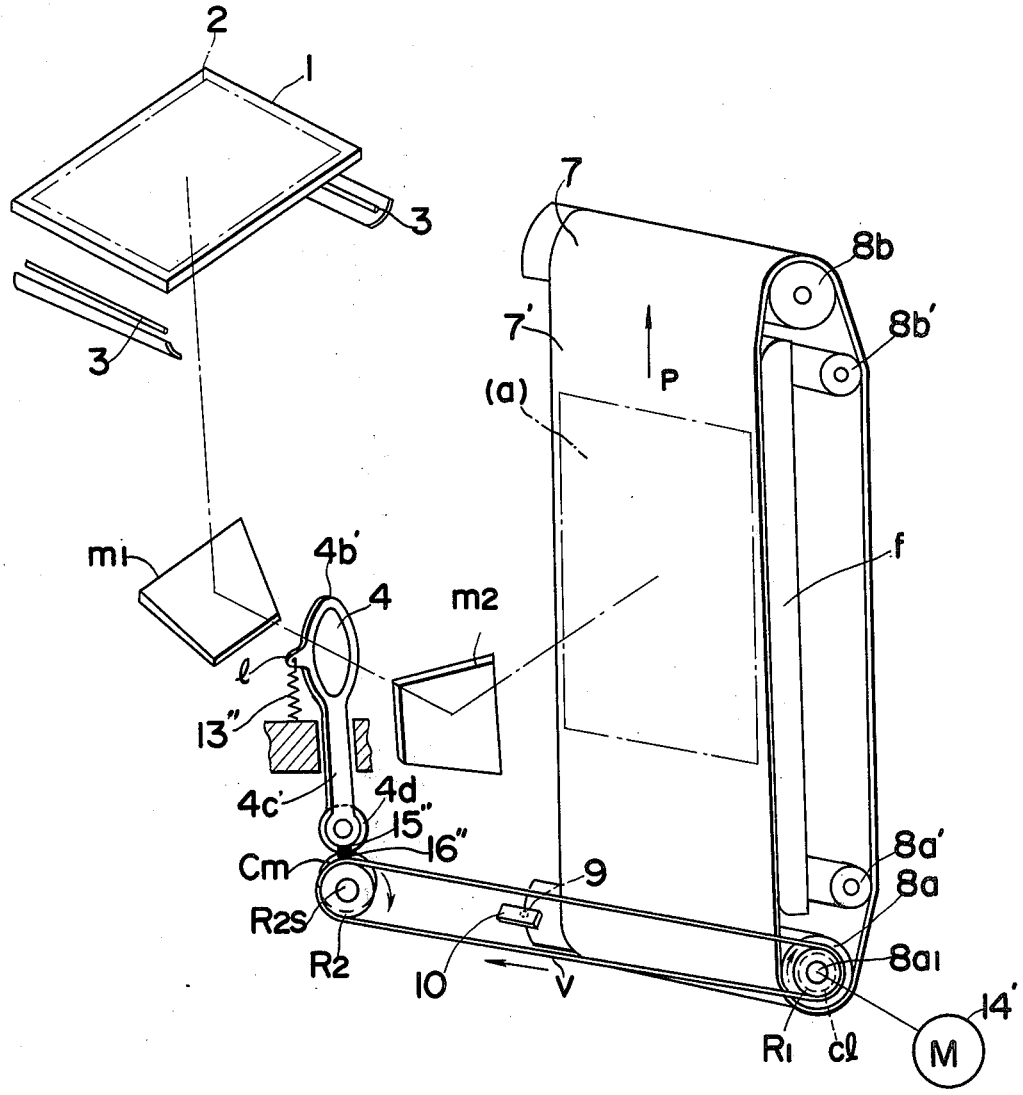

These and other objects and features of the present invention will become apparent from the following description taken in conjunction with the preferred embodiment thereof with reference to the accompanying drawings, in which;

FIG. 1 is a schematic diagram showing a cross sectional side view of an electrophotographic copying apparatus incorporating an exposure control device according to one embodiment of the invention, FIGS. 2(A) to 2(D) are schematic top plan views, on an enlarged scale and partly broken away, sequentially showing operation of the projection lens and the cam plate according to the embodiment of FIG. 1, FIG. 3 is a schematic top plan view, on an enlarged scale, showing an important part of a modification of the exposure control device of FIG. 1, and FIG. 4 is a perspective view showing important parts of an electrophotographic copying apparatus incorporating a second embodiment of an exposure control device according to the invention.

Before the description of the present invention proceeds, it is to be noted that like parts are designated by like numerals throughout several views of the accompanying drawings.

Referring to FIGS. 1 and 2, there is shown an electrophotographic copying apparatus of the full frame exposure type, wherein the exposure control device of the invention is incorporated. The electrophotographic copying apparatus includes a known photoreceptor 7 in the form of a xerographic plate having a photoconductive layer or light receiving surface 7′ on a conductive backing and in the configuration of an endless flexible belt supported by cylindrical rollers 8*a* and 8*b* with the roller 8a driven by a motor 14 for continuously advancing the photoreceptor belt 7 in the direction of the arrow at a uniform constant rate through known processing stations, such as a corona charging station, an exposure station, a developing station and a transfer station (not shown) disposed sequentially around the belt 7. An original 2 to be copied which is placed on a transparent platform 1 fixedly disposed above the photoreceptor belt 7 is illuminated by a plurality of intermittently operable lamps 3 preferably of flash flash type disposed adjacent to and below the platform 1 so as to permit high intensity illumination for a very short period of time. The light image of the original 2 thus illuminated is directed, through a mirror (not shown), into a projection lens 4 horizontally movably supported by suitable means between the platform 1 and the photoreceptor 7 and is subsequently projected, through the lens 4 and another mirror (not shown), onto the photoreceptor surface 7′ moving at the constant rate. The projection lens 4 is so timed that the same is moved at a predetermined rate in a predetermined direction when the exposure surface 7′ of the photoreceptor 7 reaches a position (a) in FIG. 1, and that the lamps 3 flash in association with the movement of the photoreceptor 7 and the projection lens 4 as described in detail hereinbelow.

In the embodiment of FIG. 1, a projection 9 is fixedly provided at a position on the outer periphery of the roller 8*a* with a microswitch 10 diposed close to the roller 8*a*, which microswitch 10 is electrically connected to a cam motor 6 so that when the projection 9 contacts the microswitch 10 as the roller 8*a* rotates, the microswitch 10 is turned on to rotate the cam motor 6, while when the projection 9 is disengaged from the microswitch 10 as the roller 8*a* further rotates, the microswitch 10 is turned off to stop the cam motor 6. Accordingly, the position and the length of the projection 9 are chosen so as to control the time and duration of rotation of the cam motor 6, and are so arranged as to operate a projection lens driving mechanism in a predetermined manner as follows.

Figures 2A, 2B, 2C, 2D:
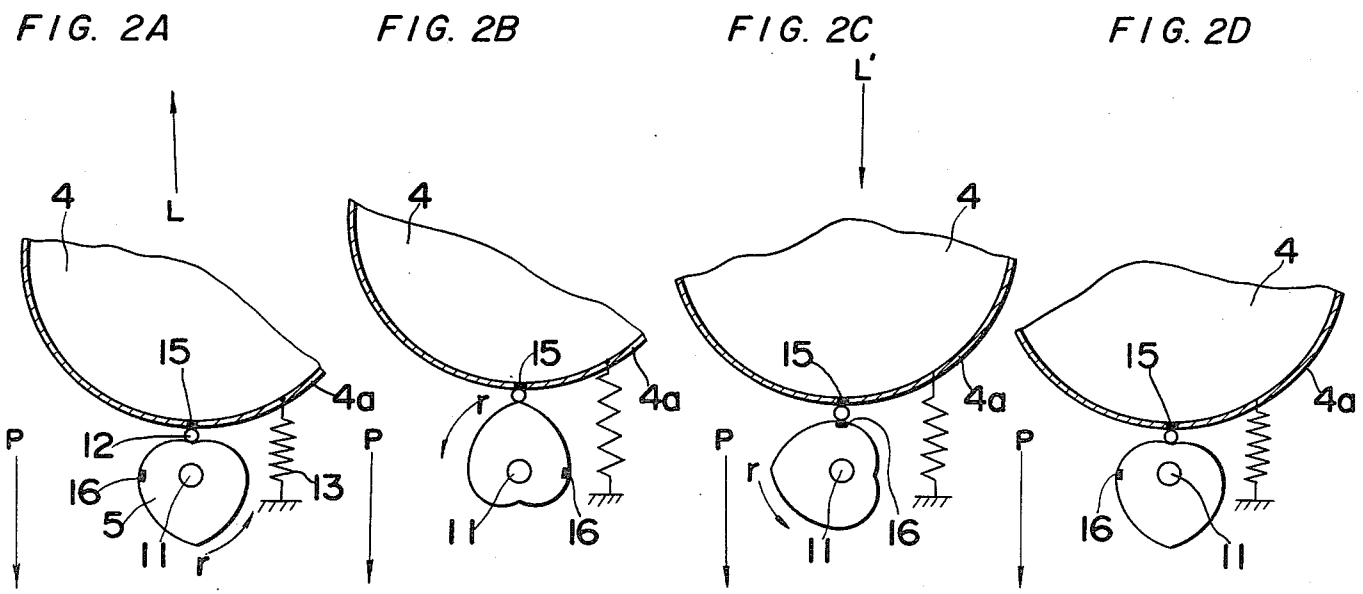

In the lens driving mechanism shown in FIGS. 1 and 2, a heart cam 5 is fixedly mounted on a rotatable cam shaft 11 connected to the cam moto 6 and is adapted to rotate in the direction of arrows r shown in FIGS. 2A–2D about the axis of the shaft 11 with the projection lens 4 reciprocating horizontally, once per each rotation of the cam plate 5, in a direction parallel to the photoreceptor surface 7′ through a small roller 12 rotatably mounted on the frame 4*a* of the lens 4. A spring is connected between the frame 4*a* of the lens 4 and a suitable frame of the copying apparatus for urging the lens 4 toward the cam plate 5 through the roller 12 so that the lens 4 positively follows the movement of the cam 5. For energizing the flash lamps 3, an electrical contact point 15 is provided on the periphery of the frame 4*a* of the lens 4, while another electrical contact point 16 is provided on the outer periphery of the cam 5, the positions of the contacts 15 and 16 being so arranged that the lamps 3 flash as the movement of the lens 4 reaches a predetermined rate as described later.

The operation of the above lens driving mechanism will be described hereinbelow with reference to FIGS. 1 and 2A–2D.

When the cam motor 6 starts rotating upon receipt of the signal from the microswitch 10 turned on by the contact with the projection 9 as the roller 8*a* rotates, with the photoreceptor 7 advancing, the cam plate 5 which is connected to the motor 6 through the cam shaft 11 rotates counterclockwise from the position in FIG. 2(A), i.e., the state wherein the lens 4 is located in the position shown by a dotted line *c* in FIG. 1, in the direction shown by the arrow r in FIG. 2(A). The rotation of the cam 5 is transmitted to the lens 4 through the roller 12 with the lens 4 moving toward the left in FIG. 1 (in the direction of the arrow L in FIG. 2(A)). After the cam plate 5 has turned one half turn to the position shown in FIG. 2(B), i.e., the state wherein the lens 4 is in the position d shown by a dotted line in FIG. 1, the lens 4 starts moving in the opposite direction to the above, i.e, toward the right in FIG. 1 (in the direction shown by an arrow L′ in FIG. 2(C)) as the cam plate 5 further rotates, which direction L′ is the same as the direction of the movement of the photoreceptor 7 shown by the arrows p in FIGS. 2(A) to 2(D). When the cam plate 5 has turned 3/4 turn to the position shown in FIG. 2(C), i.e., the state wherein the lens 4 is in the position shown by the solid line e in FIG. 1 with the light image of the original 2 projected through the lens 4 onto the exposure position (a) on the photoreceptor surface 7′, the lens 4 is moved, by the presence of the cam lobe of the cam 5, at the predetermined speed in the same direction as that of the movement of the photoreceptor 7, which predetermined rate of movement of the lens 4 equals $1/m+1v$, where $v$ is the moving speed of the photoreceptor 7 and m is the magnification for projection of the lens 4. Simultaneously, the contact points 15 and 16 provided on the outer peripheries of the frame 4*a* of the lens 4 and the cam plate 16 contact each other through the small roller 12 to allow the electric current to flow therebetween, and to energize the flash lamps 3 for the predetermined period of time, after which period of time, the cam plate 5 further rotates, with the contact points 15 and 16 disengaged, to the position shown in FIG. 2(D) and stops, in which state, the projection 9 of the roller 8*a* is disengaged from the microswitch 10.

As is seen from the above description, in the exposure control device of the invention, the microswitch 10 is turned on by the contact with the projection 9 of the roller 8*a* as the roller 8*a* rotates for actuating the cam motor 6, and when the cam plate 5 which is associated in rotation with the cam motor 6 and which the lens 4 is urged to follow reaches the predetermined position, the flash lamps 3 are energized for exposure with the lens 4 moving at the predetermined rate in the predetermined direction.

Referring now to FIG. 3, there is shown a modification of the exposure control device according to the embodiment of FIG. 1. In this modification, the frame 4*b* of the projection lens has a rod-like extension 4*c* which is pivotally supported, at the intermediate portion thereof, by a shaft s suitably secured to the frame (not shown) of the copying apparatus with an electrical contact point fixed to one side edge of the extension 4*c* at a position beyond the shaft s. A cam plate 5*a* of circular shape eccentrically fixed to the upper end of the shaft 11 for the cam motor 6 is rotatably disposed adjacent to a contact point 15′ attached to a corresponding side edge of the extension 4*c* of the lens frame 4*b* with an electrical contact point 16′ fixed on the outer periphery of the cam plate 5*a*. The contact 15′ on the extension 4*c* is urged toward the outer periphery of the cam plate 5*a* by a spring 13′ connected between the lens frame 4*b* and a suitable portion of the frame of the copying apparatus. The function of the microswitch 10 to be actuated by the projection 9 on the roller 8*a*, the electrical connection between the microswitch 10 and the cam motor 6 and the connections of the microswitch 10 and the cam plate 5*a* to the power sources are the same as in the first embodiment of FIG. 1, so that the description thereof is ommitted for brevity.

Accordingly, as the cam plate 5*a* is rotated clockwise in FIG. 3, through the shaft 11, by the cam motor 6, the projection lens 4 mounted in the frame 4*b* oscillates about the shaft *s* in the direction of the arrow. When the direction of movement of the lens 4 coincides with the moving direction *p* of the photoreceptor 7, i.e., when a line connecting the axis of the shaft *s* and the lens 4 is normal to the direction of movement *p* of the photoreceptor 7, the lens 4 is moved, by the eccentric cam 5, at the predetermined speed in the same direction as that of the photoreceptor 7, i.e., at a speed approximately equal to $1/m+1v$, where $v$ is the moving speed of the photoreceptor 7 and m is the magnification for projection of the lens 4, with contact points 15′ and 16′ contacting and with the flash lamps 3 energized. The moving direction and speed of the lens 4 corresponding to the position of the exposure surface (a) of the photoreceptor 7 and the timing for the energization of the flash lamps 3 are similar to those in the embodiment of FIG. 1, so that description thereof is omitted for brevity.

It should be noted here that the shape of the cam 5 or 5*a* should be so designed that the moving speed of the lens 4 during energization of the flash lamps 3 is equal to $1/m+1v$ as described above.

Referring now to FIG. 4, there is shown a second embodiment of the present invention. In this embodiment, the photoreceptor belt 7 supported by the cylindrical rollers 8*a* and 8*b* is further provided with corresponding tension rollers 8*a*′ and 8*b*′ rotatably disposed adjacent to the rollers 8*a* and 8*b* and also a suction plate *f* fixedly disposed adjacent to and below the exposure surface (a) of the photoreceptor surface 7′ for maintaining the exposure surface (a) flat as the photoreceptor 7 is driven in the direction of the arrow *p* through the rotation of the roller 8*a* connected to the driving motor 14′. The light image of the original 2 placed on the transparent stationary platform 1 and illuminated by the flash lamps 3 is directed into a first mirror ml disposed below the platform 1 and suitably inclined to transmit the light image to a second mirror m2 through the lens 4, which second mirror *m*2 in turn projects the light image onto the exposure surface (a).

In the second embodiment of FIG. 4, the projection lens driving mechanism directly related to the present invention includes a pulley $R_1$ rotatably mounted on the same shaft 8*a*1 as the roller 8*a* with a magnetic clutch C*l* provided between the roller 8*a* and the roller $R_1$ so that the roller $R_1$ rotates simultaneously with the roller 8*a* or is disengaged from the roller 8*a*, and another pulley $R_2$ which is fixedly mounted on a rotatable shaft $R_{2s}$ suitably journaled in a frame (not shown) of the copying machine and which is disposed below the lens 4 with a cam plate Cm fixedly mounted on the same shaft $R_{2s}$ as the pulley $R_2$ and with a belt $v$ directed over the pulleys $R_1$ and $R_2$ for rotating the roller $R_2$ clockwise shown by an arrow in FIG. 4 while the roller 8*a* is in engagement with the roller $R_1$ through the clutch C*l*. The lens frame 4*b*′ for the lens 4 has a downwardly extending portion 4*c*′ which is slidably received in a corresponding opening formed in the frame of the copying apparatus for upward or downward movement of the lens 4 in a position between the mirrors *m*1 and *m*2. A small roller 4*d* is rotatably mounted, through a pin, on the lower end of the extending portion 4*c*′ of the lens frame 4*b*′ with the outer periphery of the roller 4*d* contacting the outer periphery of the cam Cm and with spring 13″ connected between an extension *l* of the lens frame 4*b*′ and the frame of the copying apparatus for urging the small roller 4*d* of the lens frame 4*b*′ toward the cam Cm. An electrical contact point 15″ is attached to the outer periphery of the roller 4*d*, while another electrical contact point 16″ is provided on the outer periphery of the cam Cm for flashing the lamp 3 when the contact points 15″ and 16″ engage each other in a similar manner as the contact points 15 and 16 described in the embodiment of FIG. 1.

It should be noted here that, in the second embodiment of FIG. 4, the cam motor 6 described as employed for driving the cam 5 in the embodiment of FIG. 1 is dispensed with, and that the driving of the cam Cm is effected by the roller 8*a* through the clutch C*l*, and the roller $R_1$ connected to the roller $R_2$ through the belt $v$. Accordingly, the microswitch 10 and the projection 9 on the roller 8*a* are adapted to actuate the magnetic clutch C*l* in the embodiment of FIG. 4. As the photoreceptor 7 is moved in the direction of the arrow *p* as the roller 8*a* is driven by the motor 14, the projection 9 of the roller 8*a* contacts the microswitch 10 to turn the latter on, which microswitch 10, in turn, actuates the clutch C*l* to engage the roller 8*a* with the roller $R_1$. The rotation of the roller $R_1$ is transmitted to the roller $R_2$ through the belt $v$ with the cam plate Cm moving the lens 4 upward or downward as the cam plate Cm rotates with the roller $R_2$. When the direction of movement of the lens 4 coincides with the moving direction *p* of the photoreceptor 7, the lens 4 is moved, following the rotation of the cam plate Cm, at the predetermined speed in the same direction as that of the photoreceptor 7, i.e., at a speed equal to $1/m+1v$ in a similar manner to that in the first embodiment of FIG. 1 with the contact points 15″ and 16″ contacting each other for causing the lamps 3 to be flashed.

It is clear that the shape of the cam Cm should be such that the moving speed of the lens 4 during energization of the flash lamp 3 is $1/m+1v$ in the above second embodiment also.

As is clear from the foregoing description, in the exposure control device of the invention, since the lamps for illuminating the original to be copied are adapted to flash when a lens is moving at a relatively slow speed, i.e., at the speed $1/m+1$ times that of the moving speed of the photoreceptor, the quality of the image resolution is not caused to deteriorate and the life of the flash lamps is longer even though the lamps are energized for a longer period of time than in the conventional devices wherein lamps are flashed directly relative to a moving photoreceptor.

Accordingly, if the flashing time of the lamps is equal, a higher moving speed of the photoreceptor than in conventional devices is achieved in the device of the present invention, which fact makes it possible to effect high speed copying.

It goes without saying that, so long as the projection lens is one the projection surface of which is in a predetermined position on the photoreceptor surface upon energization of the flash lamps, and which moves in the same direction as the photoreceptor at the speed $1/m+1$ times a moving speed of the photoreceptor, the concept of the invention is not limited to the embodiments described hereinabove.

Although the present invention has been fully described by way of example with reference to the attached drawings, it is to be noted that various changes and modifications will be apparent to those skilled in the art. For example, the pulleys $R_1$ and $R_2$ and the belt V described as employed for driving the cam plate C*l* in the embodiment of FIG. 4 may be replaced by equivalent sprockets and a chain or by equivalent gears meshed with each other directly or through intermediate gears. Therefore, unless otherwise such changes and modifications depart from the scope of the present invention, they should be construed as included therein.

What is claimed is:

1. In an electrophotographic copying apparatus of the full frame exposure type the combination of a stationary transparent support member on which an original to be copied is placed, means for illuminating said original, an optical system including lens means for directing a light image from said original onto a photoreceptor moving at a constant rate driven by driving means, and means for exposing a full frame image of said stationary original onto a surface of said moving photoreceptor comprising means for intermittently flashing said illuminating means, means for moving said lens means for said optical system, at least during the duration of flashing time of said illuminating means, at a rate of one divided by the magnification of said lens means plus one times the moving rate of said photoreceptor, in the same direction as the moving direction of said photoreceptor, and means for synchronizing said movement of said lens means with said flashing time of said illuminating means.

2. An elctrophotographic copying apparatus as claimed in claim 1, wherein said illuminating means comprises a plurality of flash lamps fixedly disposed below and adjacent to said transparent support member.

3. An electrophotographic copying apparatus as claimed in claim 1, wherein said optical system further includes a plurality of reflecting mirrors for directing said light image onto said moving photoreceptor.

4. An electrophotographic copying apparatus as claimed in claim 1, wherein said photoreceptor is formed into a configuration of an endless belt having a photoconductive layer on a conductive backing and movably supported by a plurality of rollers to form a flat exposure surface for projecting said light image thereon, one of said photoreceptor rollers being connected to said driving means for driving said photoreceptor at the constant rate.

5. An electrophotographic copying apparatus as claimed in claim 1, wherein said lens means comprises a projection lens framed in a lens frame and horizontally, slidably disposed between said transparent support member and said exposure surface of said photoreceptor.

6. An electrophotographic copying apparatus as claimed in claim 1, wherein said moving means for said projection lens comprises a cam plate eccentrically horizontally fixed to an upper end of a shaft rotatably connected to a cam motor with the outer periphery of said lens frame urged by a spring toward the outer periphery of said cam plate through a rotatable small roller so that upon rotation of said cam plate, said projection lens is slidably, horizontally moved in a plane parallel to said photoreceptor surface, said cam motor being electrically connected to a microswitch so as to be rotated upon contact of said microswitch with a projection fixedly provided at an outer periphery of said one of said photoreceptor rollers connected to said driving means and so as to be stopped upon disengagement of said microswitch from said projection as said one of said photoreceptor rollers rotates, said microswitch being disposed in a position close to said projection.

7. An electrophotographic copying apparatus as claimed in claim 1, wherein said timing means comprises a lobe of said cam plate, and an electrical contact point provided on the outer periphery of said lens frame and another electrical contact point provided on the outer periphery of said cam plate, said electrical contact points serving as said means for intermittently flashing said illuminating means when in contact with each other, said lobe of said cam plate being so designed that the moving rate of said lens, during said duration of said flashing time of said flash lamps, is equal to one divided by said magnification of said lens plus one times the moving rate of said photoreceptor.

8. An electrophotographic copying apparatus as claimed in claim 1, wherein said lens means comprises a projection lens framed in a lens frame having an extending portion therefrom with an intermediate portion of said extending portion pivotally supported by a pin, so that said projection lens rotates about said pin in directions parallel to the surface of said photoreceptor between said transparent support member and said exposure surface of said photoreceptor.

9. An electrophotographic copying apparatus as claimed in claim 8, wherein said moving means for said projection lens comprises a cam plate eccentrically, horizontally fixed to an upper end of a shaft rotatably connected to a cam motor with one side edge of said extending portion beyond said pivotal connection urged by a spring toward an outer periphery of said cam plate so that upon rotation of said cam plate, said projection lens is pivotally rotated about said pivotal connection in a plane parallel to said photoreceptor surface, said cam motor being electrically connected to a microswitch so as to be rotated upon contact of said microswitch with a projection fixedly provided at an outer periphery of said one of said photoreceptor rollers connected to said driving means and so as to be stopped upon disengagement of said microswitch from said projection as said one of said photoreceptor rollers rotates, said microswitch being disposed in a position close to said projection.

10. An electrophotographic copying apparatus as claimed in claim 1, wherein said exposure surface of said photoreceptor is disposed in a direction normal to the surface of said stationary transparent support member, said optical system being arranged to direct the light image of said original, through a pair of fixed mirrors which are suitably inclined with said lens means therebetween, onto said exposure surface of said moving photoreceptor.

11. An electrophotographic copying apparatus as claimed in claim 10, wherein said lens means comprises a projection lens framed in a lens frame having a downwardly extending portion therefrom which is slidably received in a corresponding opening formed in a frame of said copying apparatus for reciprocating upward and downward movement in a direction parallel to said exposure surface of said photoreceptor between said pair of mirrors with a small roller rotatably mounted at the lower end of said downwardly extending portion.

12. An electrophotographic copying apparatus as claimed in claim 10, wherein said moving means for said projection lens comprises a first wheel member mounted, through clutch means, on one end of a shaft of said one of said photoreceptor rollers connected to said driving means, for simultaneous rotation with said one of said photoreceptor rollers when engaged therewith and for remaining stationary when disengaged therefrom, a second wheel member rotatably mounted on a shaft fixedly disposed below and adjacent to said small roller of said downwadly extending portion of said lens frame, a cam plate eccentrically mounted on the same shaft as said second wheel member and fixed to said second wheel member for simultaneous rotation therewith, with said second wheel member connected to said first wheel member through transmission means and with an outer periphery of said small roller of said extending portion being urged against the outer periphery of said cam plate by a spring so that, upon rotation of said first wheel member, said projection lens reciprocates in a plane parallel to said exposure surface of said moving photoreceptor, said clutch means being electrically connected to a microswitch so as with be energized to engage said first wheel member to said one of said photoreceptor rollers upon contact of said microswitch with a projection fixedly provided at an outer periphery of said one of said photoreceptor rollers and so as to be de-energized upon disengagement of said microswitch from said projection as said one of said photoreceptor rollers rotates, said microswitch being disposed in a position close to said projection.

13. An electrophotographic copying apparatus as claimed in claim 12, wherein said first and second wheel members are pulleys with said transmission means being a belt.

14. An electrophotographic copying apparatus as claimed in claim 12, wherein said first and second wheel members are sprockets with said transmission means being a chain.

15. An electrophotographic copying apparatus as claimed in claim 12, wherein said first and second wheel members are gears.

16. An electrophotographic copying apparatus as claimed in claim 12, wherein said timing means comprises a lobe of said cam, and an elctrical contact point provided on the outer periphery of said lens frame and another electrical contact point provided on the outer periphery of said cam plate, said electrical contact points serving as said means for intermittently flashing said illuminating means when in contact with each other, said lobe of said cam being so designed that the moving rate of said lens, during said duration of said flashing time of said flash lamps, is equal to one divided by said magnification of said lens plus one times the moving rate of said photoreceptor.

* * * * *